US006923529B2

(12) United States Patent
Chwalek et al.

(10) Patent No.: US 6,923,529 B2
(45) Date of Patent: Aug. 2, 2005

(54) INK-JET PRINTING WITH REDUCED CROSS-TALK

(75) Inventors: James M. Chwalek, Pittsford, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 539 days.

(21) Appl. No.: 10/035,902

(22) Filed: Dec. 26, 2001

(65) Prior Publication Data

US 2003/0117465 A1 Jun. 26, 2003

(51) Int. Cl.[7] ..... B21J 2/07
(52) U.S. Cl. ..... 347/74
(58) Field of Search ..... 347/74, 40, 75–77, 347/80, 82, 90

(56) References Cited

U.S. PATENT DOCUMENTS

| | | | | | |
|---|---|---|---|---|---|
| 1,941,001 | A | | 12/1933 | Hansell | 178/96 |
| 3,373,437 | A | | 3/1968 | Sweet et al. | 347/94 |
| 3,416,153 | A | | 12/1968 | Hertz et al. | 347/73 |
| 3,709,432 | A | | 1/1973 | Robertson | 239/4 |
| 4,050,077 | A | * | 9/1977 | Yamada et al. | 347/75 |
| 4,068,241 | A | | 1/1978 | Yamada | 347/75 |
| 4,251,823 | A | | 2/1981 | Sagae | 347/12 |
| 4,346,387 | A | | 8/1982 | Hertz | 347/75 |
| 4,427,986 | A | | 1/1984 | Iyoda et al. | 347/76 |
| 4,849,909 | A | * | 7/1989 | Yamada et al. | 347/776 |
| 6,079,821 | A | | 6/2000 | Chwalek et al. | 347/82 |
| 6,457,807 | B1 | * | 10/2002 | Hawkins et al. | 347/40 |
| 6,474,781 | B1 | | 11/2002 | Jeanmaire | 347/47 |
| 6,505,921 | B2 | * | 1/2003 | Chwalek et al. | 347/77 |
| 6,536,883 | B2 | * | 3/2003 | Hawkins et al. | 347/77 |

FOREIGN PATENT DOCUMENTS

| | | |
|---|---|---|
| EP | 0 782 926 A1 | 7/1997 |
| EP | 1 060 889 A2 | 12/2000 |
| EP | 1 232 864 A2 | 8/2002 |

* cited by examiner

*Primary Examiner*—K. Feggins
(74) *Attorney, Agent, or Firm*—Milton S. Sales; Mark G. Bacchetti

(57) ABSTRACT

An ink jet printer having an array of nozzles from which ink droplets of adjustable volume are emitted further includes a mechanism adapted to individually adjust the volume of the emitted ink droplets. The mechanism has a first state wherein the emitted droplets of selected nozzles are of a predetermined small volume and a second state wherein the emitted droplets of selected nozzles are of a predetermined large volume. A controller selectively switches the mechanism between its first and its second states such that ink droplets of the predetermined large volume are not simultaneously emitted from adjacent ones of the nozzles.

9 Claims, 5 Drawing Sheets

INK-JET PRINTING WITH REDUCED CROSS-TALK

FIELD OF THE INVENTION

This invention relates generally to the field of digitally controlled printing devices, and in particular to ink jet printers in which a continuous stream of ink droplets are emitted from a print head, some of which droplets being selectively deflected.

BACKGROUND OF THE INVENTION

Traditionally, digitally controlled color ink jet printing capability is accomplished by one of two technologies. Both require independent ink supplies for each of the colors of ink provided. Ink is fed through channels formed in the print head. Each channel includes a nozzle from which droplets of ink are selectively extruded and deposited upon a receiving medium. Typically, each technology requires separate ink delivery systems for each ink color used in printing. Ordinarily, the three primary subtractive colors, i.e., cyan, yellow and magenta, are used because these colors can produce, in general, up to several million perceived color combinations.

The first technology, commonly referred to as "drop-on-demand" ink jet printing, typically provides ink droplets for impact upon a recording surface using a pressurization actuator (thermal, piezoelectric, etc.). Selective activation of the actuator causes the formation and ejection of a flying ink droplet that crosses the space between the print head and the print media and strikes the print media. The formation of printed images is achieved by controlling the individual formation of ink droplets, as is required to create the desired image. Typically, a slight negative pressure within each channel keeps the ink from inadvertently escaping through the nozzle.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When print is desired, the ink droplets are directed to strike a print media.

Typically, continuous ink jet printing devices are faster than drop-on-demand devices and produce higher quality printed images and graphics. However, each color printed requires an individual droplet formation, deflection, and capturing system.

U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink droplets to be printed are selectively charged and deflected towards the recording medium. This technique is known as binary deflection continuous ink jet.

U.S. Pat. No. 3,416,153, issued to Hertz et al. on Oct. 6, 1963, discloses a method of achieving variable optical density of printed spots in continuous ink jet printing using the electrostatic dispersion of a charged droplet stream to modulate the number of droplets which pass through a small aperture.

Conventional continuous ink jet printers use electrostatic deflection by a charging tunnel and deflection plates. U.S. Pat. No. 4,346,387, issued to Hertz on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are controlled, resulting in short filaments and longer filaments. A flow of air is across the paths of the fluid at a point intermediate to the ends of the long and short filaments affects the trajectories of the filaments before they break up into droplets. By controlling the lengths of the filaments, the trajectories of the ink droplets can be controlled, or switched from one path to another. As such, some ink droplets may be directed into a catcher while allowing other ink droplets to be applied to a receiving member.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non printed ink droplet path ultimately striking a catcher surface. Non-printed ink droplets are recycled or disposed of through an ink removal channel formed in the catcher.

The use of an air stream has been proposed to separate ink drops of a plurality of volumes into spatially differing trajectories. Non-imaging droplets, having one grouping of volumes, is not permitted to reach the image receiver, while imaging droplets having a significantly different range of volumes are permitted to make recording marks on the receiver.

It has been found that good discrimination between large volume droplets and small volume droplets is generaly obtained when the volume of large droplets is about three times greater than the volume of small droplets. As the packing density of nozzles on a print head increases (the nozzles get closer together), adjacent large drops may actually touch one another during flight. If they touch, the droplets will coalesce. Clearly, this would have a negative effect on the printed image were the large droplets selected to reach the receiver, but coalescence could be a problem in the guttering process if the large droplets were selected to be non-printing.

It is desirable to integrate a high density of closely spaced nozzles on a print head. Thus, there is a opportunity to provide a modified ink jet print head and printer having simple control of individual ink droplets with an increased amount of physical separation between large droplets.

SUMMARY OF THE INVENTION

It is an object of the present invention to maximize the amount of physical separation between large ink droplets.

According to a feature of the present invention 1, an ink jet printer having an array of nozzles from which ink droplets of adjustable volume are emitted further includes a mechanism adapted to individually adjust the volume of the emitted ink droplets. The mechanism has a first state wherein the emitted droplets of selected nozzles are of a predetermined small volume and a second state wherein the emitted droplets of selected nozzles are of a predetermined large volume. A controller selectively switches the mechanism between its first and its second states such that ink droplets of the predetermined large volume are not simultaneously emitted from adjacent ones of the nozzles.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
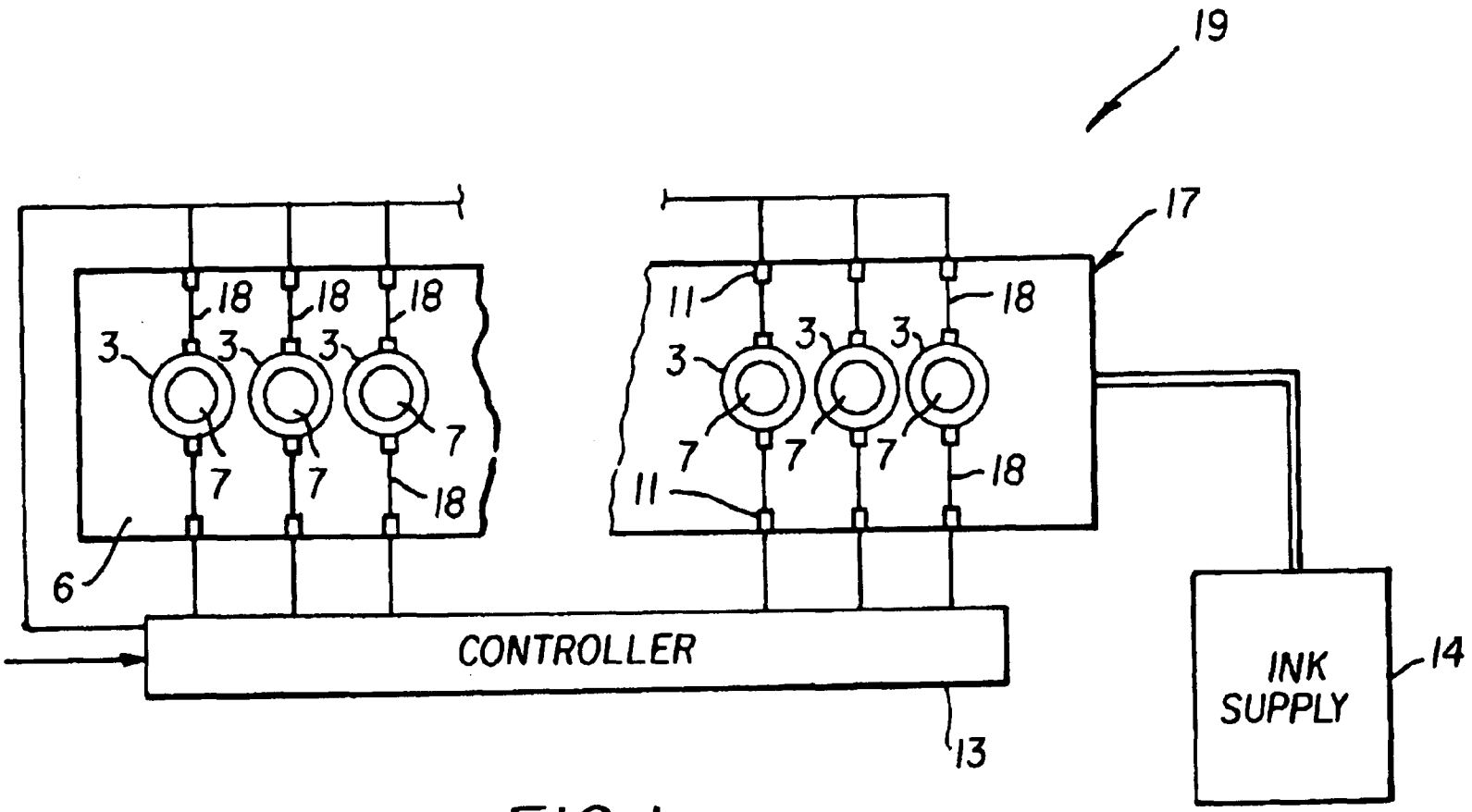
FIG. 1 is a schematic plan view of a print head made in accordance with a preferred embodiment of the present invention.

Referring to FIG. 1, an ink droplet forming mechanism 19 includes a print head 17, at least one ink supply 14, and a controller 13. Although ink droplet forming mechanism 19 is illustrated schematically and not to scale for the sake of clarity, one of ordinary skill in the art will be able to readily determine the specific size and interconnections of the elements of a practical mechanism.

Nozzles 7 are in fluid communication with ink supply 14 through an ink passage (not shown) also formed in print head 17. Print head 17 may incorporate additional ink supplies in the manner of ink supply 14 and corresponding nozzles 7 in order to provide color printing using three or more ink colors. Single color printing may be accomplished using a single ink supply.

A heater 3 is at least partially formed or positioned on print head 17 around a corresponding nozzle 7. Although the heaters may be disposed radially away from an edge of the corresponding nozzle 7, heaters 3 are preferably disposed close to their corresponding nozzle 7 in a concentric manner. In a preferred embodiment, the heaters are formed in a substantially circular or ring shape. However, it is specifically contemplated, and therefore within the scope of this disclosure, that heaters 3 may be formed in a partial ring, square, etc. Heaters 3 in a preferred embodiment consist principally of electric resistive heating elements electrically connected to electrical contact pads 11 via conductors 18.

Conductors 18 and electrical contact pads 11 may be at least partially formed or positioned on print head 17 and provide electrical connection between controller 13 and heaters 3. Alternatively, the electrical connection between controller 13 and heaters 3 may be accomplished in any well-known manner. Additionally, controller 13 may be a relatively simple device (a power supply for heaters 3, etc.) or a relatively complex device (logic controller, programmable microprocessor, etc.) operable to control many components.

Print head 17 is able to create drops having a plurality of volumes. In the preferred implementation of this invention, larger drops are used for printing, while smaller drops are prevented from striking an image receiver. The creation of ink drops involves the activation of the heater associated with a nozzle, activation being with an appropriate waveform to cause a jet of ink fluid to break up into droplets having a plurality of volumes. Such waveforms may include different amplitude and/or different frequency for different drop volume, etc.

Figure 2:
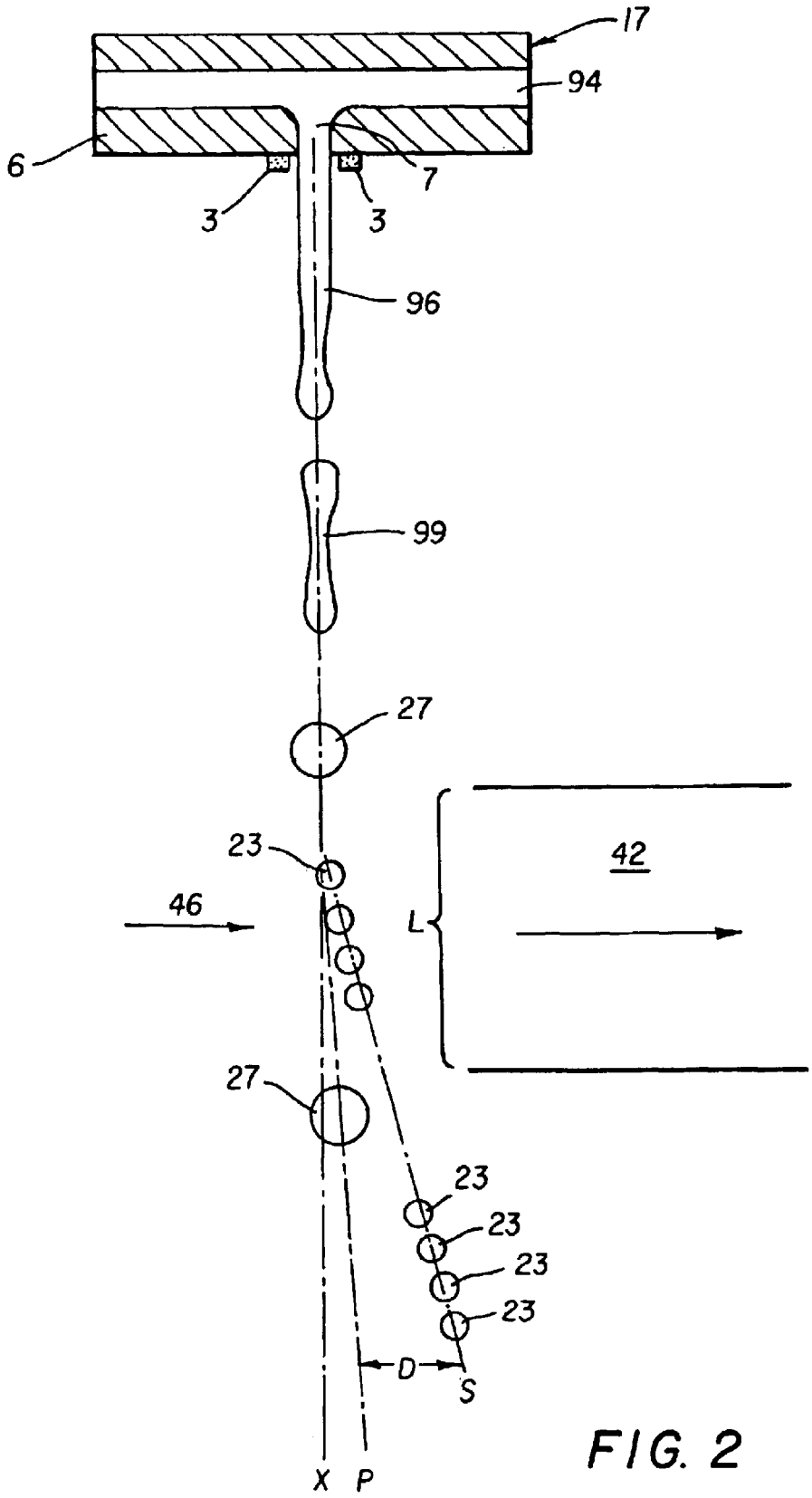
FIG. 2 is a sectional schematic view of ink from a nozzle in the print head of FIG. 1.

Referring to FIG. 2, pressurized ink 94 from ink supply 14 is ejected through nozzle 7, which is one member of a group in print head 17, creating a filament 96 of working fluid. Heater 3 is selectively activated at various amplitudes and/or frequencies according to image data, causing filament 96 of working fluid to break up into a stream of individual ink droplets. At the distance from the print head 17 that a discriminator is applied, droplets are substantially in two size classes: small, non-printing drops 23 and large, printing drops 27. In the preferred implementation, the discriminator provides a force 46 of a gas flow in droplet deflector 42, perpendicular to axis X. Force 46 acts over distance L. Large, printing drops 27 have a greater mass and more momentum than small, non-printing drops 23. As gas force 46 interacts with the stream of ink droplets, the individual ink droplets separate depending on each droplet's volume and mass. Accordingly, the gas flow rate in droplet deflector 42 can be adjusted to provide sufficient differentiation D between the small droplet path S and the large droplet path P, permitting large, printing drops 27 to strike print media, not shown, while small non-printing drops 23 are deflected as they travel and are captured by a ink guttering structure described below.

With reference to a preferred embodiment, a negative gas pressure or gas flow at one end of droplet deflector 42 tneds to separate and deflect ink droplets. An amount of differentiation between the large, printing drops 27 and the small, non-printing drops 23 (shown as D in FIG. 2) will not only depend on their relative size but also the velocity, density, and the viscosity of the gas at droplet deflector 42; the velocity and density of the large, printing drops 27 and small, non-printing drops 23; and the interaction distance (shown as L in FIG. 2) over which the large, printing drop 27 and the small, non-printing drops 23 interact with the gas flowing from droplet deflector 42 with force 46. Gases, including air, nitrogen, etc., having different densities and viscosities can also be used with similar results.

Large, printing drops 27 and small, non-printing drops 23 can be of any appropriate relative size. However, the droplet size is primarily determined by ink flow rate through nozzle 7 and the frequency at which heat 3 is cycled. The flow rate is primarily determined by the geometric properties of nozzle 7 such as nozzle diameter and length, pressure applied to the ink, and the fluidic properties of the ink such as ink, viscosity, density, and surface tension.

Figure 3:
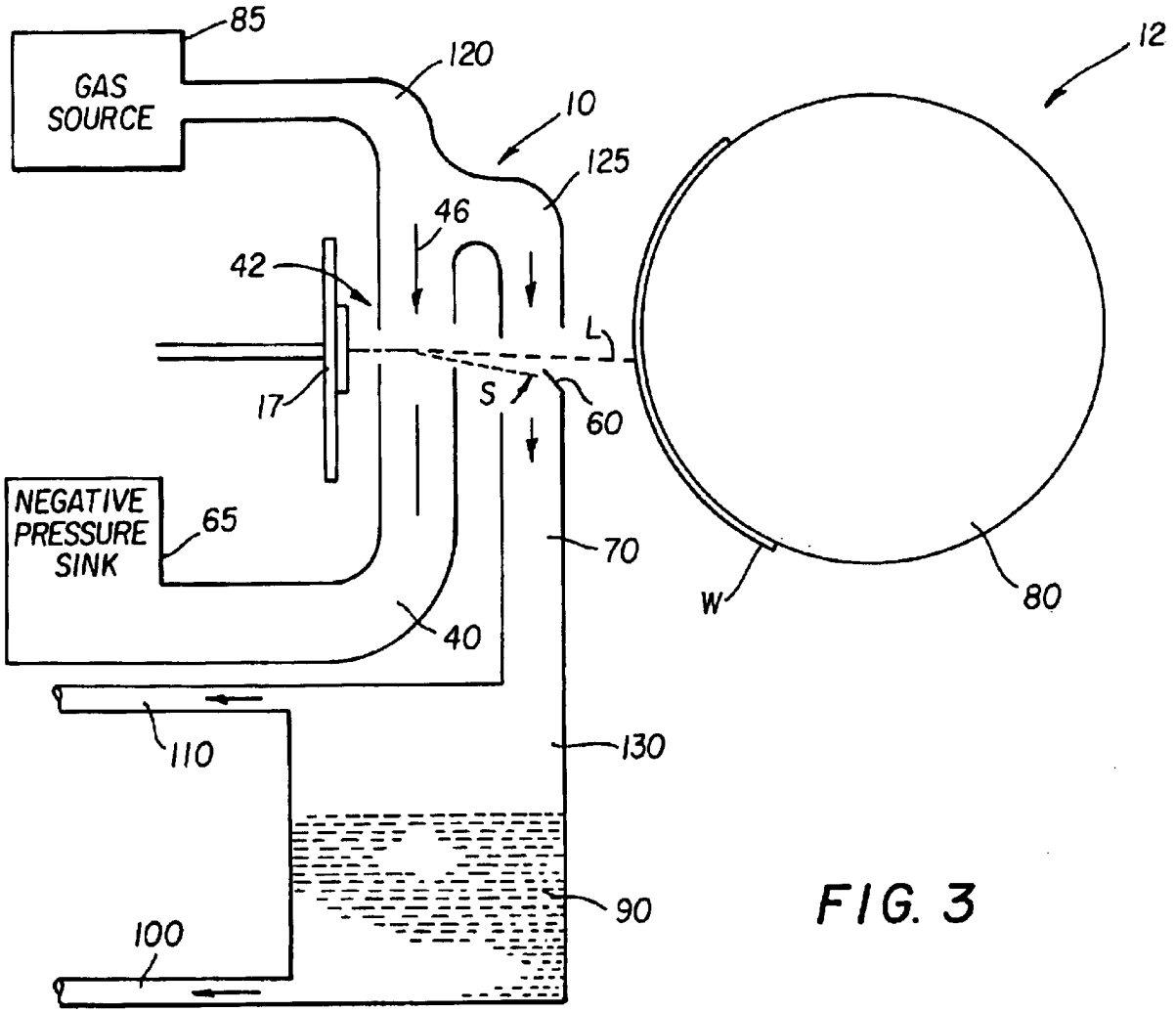
FIG. 3 is a schematic view of an ink jet printer made in accordance with the preferred embodiment of the present invention.

FIG. 3 shows a printing apparatus 12, which is typically an ink jet printer. Large, printing drops 27 and small, non-printing drops 23 are ejected from print head 17 substantially along ejection path X. A droplet deflector 42 applies a force (shown generally at 46) to ink drops 27 and 23 as they travel along path X. Force 46 interacts with ink drops 27 and 23 along path X, causing the ink drops 27 and 23 to alter course. As large, printing drops 27 have different volumes and masses from small, on-printing drops 23, force 46 causes small, non-printing drops 23 to separate from large, printing drops 27 with small, non-printing drops 23 diverging from path X along small droplet path S. While large, printing drops 27 can be slightly affected by force 46, large, printing drops 27 are only slightly deflected from path X to path P.

Droplet deflector 42 can include a gas source 85 that communicates with upper plenum 120 to provide force 46. Additionally, a vacuum conduit 40, coupled to a negative pressure sink 65 promotes laminar gas flow and increases force 46. Typically, force 46 is positioned at an angle with respect to the stream of ink droplets operable to selectively deflect ink droplets depending on ink droplet volume. Ink droplets having a smaller volume are deflected more than ik droplets having a larger volume.

Gas source 85 and upper plenum 120 also facilitate flow of gas through plenum 125. The end of plenum 125 is positioned proximate drop parths S and P. A recovery conduit 70 is disposed opposite the end of plenum 125 and promotes laminar gas flow while protecting the droplet stream moving along paths S and P from external air disturbances. An ink recovery conduit 70 contains a ink guttering structure 60 whose purpose is to intercept the path S of small, non-printing drops 23, while allowing large, printing drops 27, traveling along large drop path P, to continue on to the recording media W carried by print drum 80. Ink recovery conduit 70 communicates with ink recovery reservoir 90 to facilitate recovery of non-printed ink droplets by an ink return line 100 for subsequent reuse. Ink recovery reservoir contains open-cell sponge or foam 130 that prevents ink sloshing in applications where the print head 17 is rapidly scanned. A vacuum conduit 110, coupled to a negative pressure source (not shown) can communicate with ink recovery reservoir 90 to create a negative pressure in ink recovery conduit 70 improving ink droplet separation and ink droplet removal. In a preferred implementation, the gas pressure in droplet deflector 42, plenum 125, and in ink recovery conduit 70 are adjusted in combination with the design of ink recovery conduit 70 so that the gas pressure in the print head assembly near ink guttering structure 60 is positive with respect to the ambient air pressure near print drum 80. Environmental dust and paper fibers are thusly discouraged from approaching and adhering to ink guttering structure 60 and are additionally excluded from entering ink recovery conduit 70.

Figure 4:
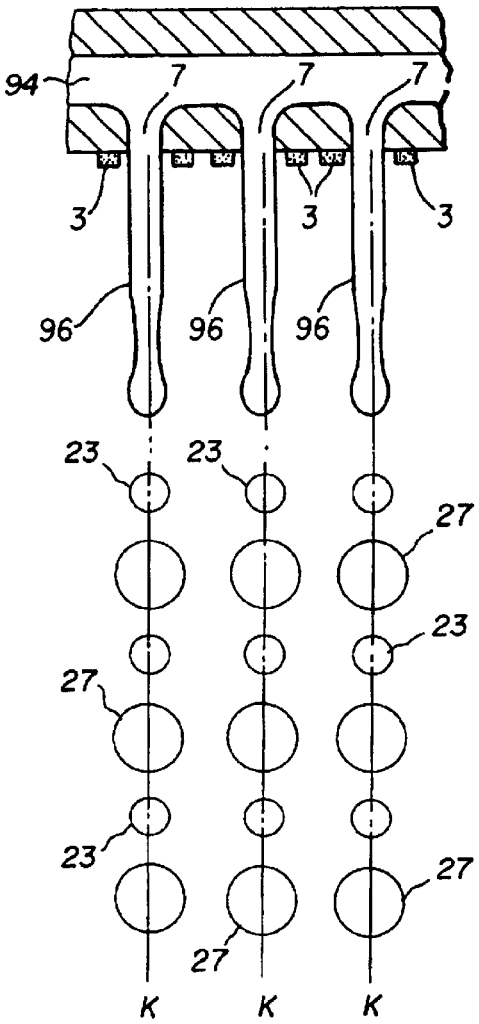
FIG. 4 (PRIOR ART)
FIG. 4 is a cross-sectional view of an ink jet print head operated in accordance with the prior art.

Referring to FIG. 4, which is a cross-section of print head 17 and associated ink jets of working fluid 96, pressurized ink 94 from ink supply 14 (FIG. 1) is ejected through nozzles 7 along axes K, which are substantially perpendicular to the front surface of print head 17. Heaters 3 associated with nozzles 7 are activated in a substantially similar manner. The example diagrammed in FIG. 4 is for heater activation according to alternating non-printing and printing pixels. Working fluid 96 breaks up into a uniformly sized series of small, non-printing drops 21 moving along axes K. Depending upon the image to be printed, any of the plurality of nozzles 7 may be activated to produce large, printing drops 23 at any print interval. This is depicted in FIG. 4 by showing alternating lines of non-printing drops 21 and printing drops 23.

As mentioned above, it is desirable to integrate a high density of closely spaced nozzles on the print head. Difficulty will be experienced in situations where it is necessary to produce adjacent large droplets. As the packing density of nozzles on a print head increases (the nozzles get closer together), adjacent large droplets may actually touch one another during flight. If they touch, the droplets will coalesce. Clearly, this would have a negative effect on the printed image were the large droplets selected to reach the receiver, but coalescence could be a problem in the guttering process if the large droplets were selected to be non-printing. Even if adjacent droplets do not actually touch, air entrainment as the droplets travel through the air could create air disturbances around a droplet that may interfere with neighboring droplets.

Figure 5:
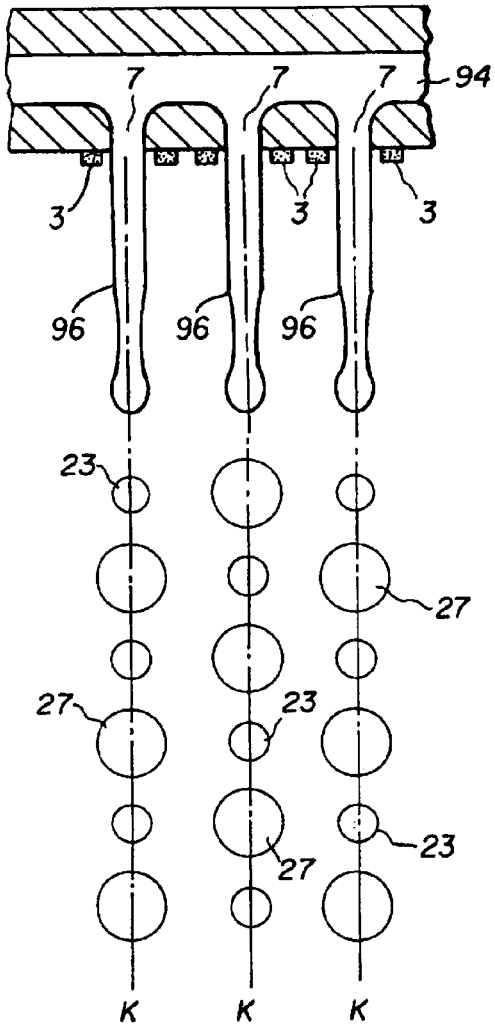
FIG. 5 is a cross-sectional view of an ink jet print head operated in accordance with a preferred embodiment of the present invention.

In order to integrate a high density of closely spaced nozzles on a print head, we have provided a modified ink jet print head and printer having simple control of individual ink droplets with an increased amount of physical separation between large droplets. Referring to FIG. 5, the print head is controlled so that firing of adjacent channels such as to create large droplets that are staggered, or out of phase with their nearest neighbors, such that no two nearest adjacent nozzles produce large droplets at the same time. As seen in FIG. 5, large droplets are interlaced with small drops.

Figure 6:
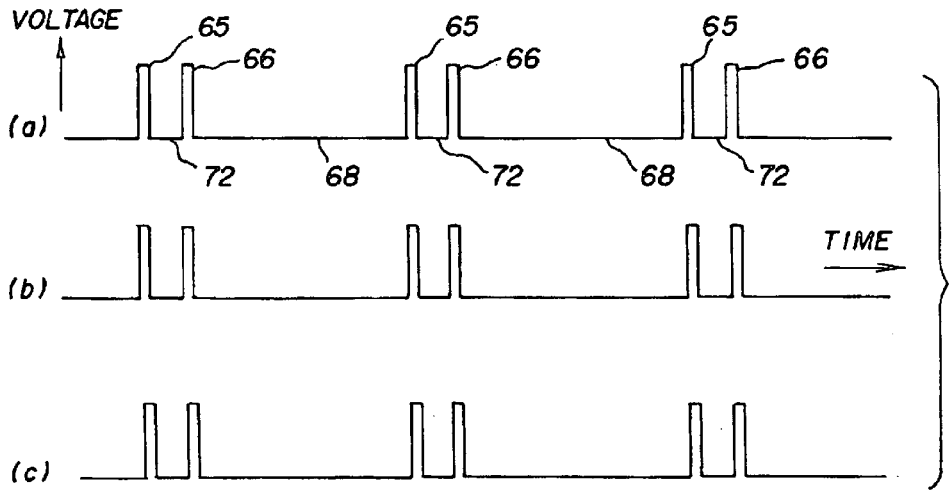
FIG. 6 illustrates the frequency control of heaters shown in FIG. 4.

FIG. 6, is an illustration of the frequency control of the heaters used to create the non-printing 23 and printing drops 27 shown in FIG. 4. FIGS. 6(*a*)–(*c*) are the voltage as a function of time applied to the heaters 3 surrounding the three nozzles 7 in FIG. 4. The waveform consists of two heater activation pulses 65 and 66, separated by delay time 72. Delay 72 is chosen to be less than delay 68, preferably less by a factor of 4 or more as discussed in the prior art. The activation of heater 3 according to this waveform, forms two drops, one smaller printing drop 23 and a larger non-printing drop 27 as shown schematically in FIG. 4. Note that the pulses for all of the nozzles are concurrent in time.

Figure 7:
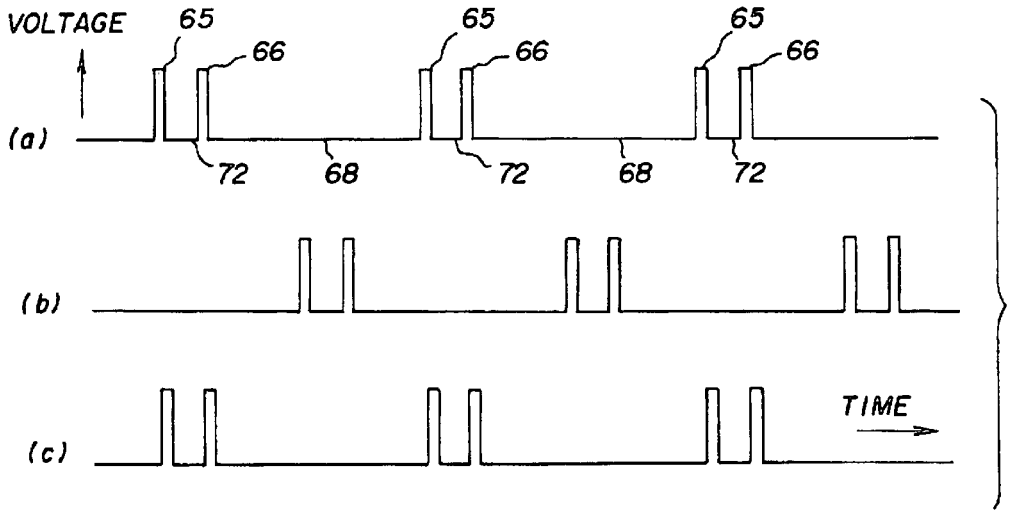
FIG. 7 illustrates the waveforms used to create drops shown in FIG. 5.

FIG. 7, is an illustration of the waveforms used to create the non-printing 23 and printing drops 21 shown in FIG. 5. In this case, the applied voltage pulses are staggered in time with respect to the nearest neighboring nozzles. The result is that the drops are staggered spatially as illustrated in FIG. 7. In the case illustrated in FIG. 7 the optimal amount of time delay between nearest neighboring nozzles would be such that the start of pulse 65 in FIG. 7(*b*) would be delayed by one-half of the total sum of delays 72 and 68 with respect to the start of pulse 65 in FIG. 7(*a*). Depending upon the image to be printed, printing drops 23 may occur at any time interval and as such the optimal time delay may be different.

Printing droplets may arrive at slightly different than optimal time for the best resolution, but depending on the paper speed, there would be only a slight loss of resolution. On the other hand, the staggered, out of phase effect would actually work in one's favor by reducing the risk of droplets bleeding together upon impact on the receiver.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. An ink jet printer comprising:

a print head having a single linear array of nozzles from which ink droplets of adjustable volume are emitted;

a mechanism adapted to individually adjust the volume of the emitted ink droplets, said mechanism having a first state wherein the emitted droplets of selected nozzles are of a predetermined small volume and a second state wherein the emitted droplets of selected nozzles are of a predetermined large volume; and a controller adapted to selectively switch the mechanism between its first and its second states such that ink droplets of said predetermined large volume are not simultaneously emitted from adjacent ones of said nozzles.

2. An ink jet printer as set forth in claim 1, wherein said mechanism adapted to adjust the volume of the emitted ink droplets includes a heater positioned proximate said nozzle, said heater being adapted to selectively create said ink droplets having small volume and said ink droplets having large volume.

3. An ink jet printer as set forth in claim 1, wherein said droplets are emitted substantially simultaneously from all the nozzles of the array.

4. An ink jet printer comprising:

a print head having a single linear array of nozzles from which streams of ink are emitted, said ink streams breaking up into droplets of adjustable volume moving along a path;

a mechanism adapted to individually adjust the volume of the emitted ink droplets, said mechanism having a first state wherein the emitted droplets of selected nozzles are of a predetermined small volume and a second state wherein the emitted droplets of selected nozzles are of a predetermined large volume; and a controller adapted to selectively switch the mechanism between its first and its second states such that ink droplets of said predetermined large volume from adjacent ones of said nozzles do not simultaneously occur.

5. An ink jet printer as set forth in claim 4, further comprising a droplet deflector which uses a flow of gas positioned at an angle greater than zero with respect to said ink droplet path, said droplet deflector being adapted to interact with said ink droplets, thereby separating ink droplets of said predetermined small volume from ink droplets of said predetermined large volume.

6. An ink jet printer as set forth in claim 5, wherein said droplet deflector includes a recovery plenum positioned adjacent said stream of ink droplets operable to collect and remove ink droplets.

7. A method of ink jet printing using a print head having one linear array of nozzles from which ink droplets of adjustable volume are emitted;

individually adjusting the volume of the emitted ink droplets such that the emitted droplets of selected nozzles are of predetermined small volume or of a predetermined large volume; and controlling the size of the ink droplets such that ink droplets of said predetermined large volume are not simultaneously emitted from adjacent ones of said nozzles of said one linear array.

8. An ink jet printer comprising:

a print head having a linear array of at least three nozzles from which ink droplets of adjustable volume are emitted;

a mechanism adapted to individually adjust the volume of the emitted ink droplets, said mechanism having a first state wherein the emitted droplets of selected nozzles are of a predetermined small volume and a second state wherein the emitted droplets of selected nozzles are of a predetermined large volume; and a controller adapted to selectively switch the mechanism between its first and its second states such that ink droplets of said predetermined large volume are not simultaneously emitted from adjacent ones of said nozzles.

9. A method of ink jet printing using a print head having a linear array of at least three nozzles from which ink droplets of adjustable volume are emitted;

individually adjusting the volume of the emitted ink droplets such that the emitted droplets of selected nozzles are of predetermined small volume or of a predetermined large volume; and controlling the size of the ink droplets such that ink droplets of said predetermined large volume are not simultaneously emitted from adjacent ones of said nozzles of said linear array.

* * * * *